US009068789B2

(12) United States Patent
Glock

(10) Patent No.: US 9,068,789 B2
(45) Date of Patent: Jun. 30, 2015

(54) MARKING OF THE BARREL OF A FIREARM

(75) Inventor: Gaston Glock, Velden (AT)

(73) Assignee: VALUE PRIVATSTIFTUNG (AT)

( * ) Notice: Subject to any disclaimer, the term of this patent is extended or adjusted under 35 U.S.C. 154(b) by 0 days.

(21) Appl. No.: 13/573,266

(22) Filed: Sep. 6, 2012

(65) Prior Publication Data

US 2013/0239451 A1 Sep. 19, 2013

(30) Foreign Application Priority Data

Sep. 7, 2011 (EP) ..... 11450115

(51) Int. Cl.
*F41A 21/00* (2006.01)
*F41A 21/18* (2006.01)

(52) U.S. Cl.
CPC ..... *F41A 21/18* (2013.01)

(58) Field of Classification Search
CPC ..... F41A 21/18; F41A 21/04; F41A 21/02; F41A 21/16; B21C 37/152
USPC ..... 42/78, 76.01, 76.02, 77, 76
See application file for complete search history.

(56) References Cited

U.S. PATENT DOCUMENTS

| | | | | | |
|---|---|---|---|---|---|
| 1,344,992 | A | * | 6/1920 | Darley, Jr. | 89/1.1 |
| 1,355,421 | A | * | 10/1920 | Pedersen | 42/78 |
| 1,355,422 | A | * | 10/1920 | Pedersen | 42/78 |
| 1,777,771 | A | * | 10/1930 | Scherf | 42/78 |
| 2,104,319 | A | * | 1/1938 | Dicke | 42/78 |
| 2,549,832 | A | * | 4/1951 | Mackta | 42/78 |
| 2,636,849 | A | * | 4/1953 | Brenner | 205/73 |
| 3,100,358 | A | * | 8/1963 | Robinson, Jr. | 42/78 |
| 3,571,962 | A | * | 3/1971 | Eig | 42/76.02 |
| 3,780,465 | A | * | 12/1973 | Polcha | 148/565 |
| 3,788,188 | A | * | 1/1974 | Donner | 89/1.3 |
| 8,025,003 | B1 | * | 9/2011 | Saur | 89/14.05 |

FOREIGN PATENT DOCUMENTS

EP 11450115 9/2011

* cited by examiner

*Primary Examiner* — Samir Abdosh
(74) *Attorney, Agent, or Firm* — Kolisch Hartwell, P.C.

(57) ABSTRACT

The invention concerns a marking for the barrel of a firearm, in particular of a pistol, a rifle, or a carbine, with a barrel cross section the perimeter of which alternately consists of linear, polygonal segments and arched segments, where necessary with transitions between them, whereby the linear, polygonal segments define an inscribed circle, further comprising at least two ribs being provided in or on the arched segments which extend radially inward.

7 Claims, 2 Drawing Sheets

MARKING OF THE BARREL OF A FIREARM

This application claims priority to European Patent Application No. EP11450115, filed Sep. 7, 2011 which is incorporated by reference in its entirety as if set forth herein.

BACKGROUND OF THE INVENTION

1. Field of the Invention

The invention concerns the marking of the barrel of a firearm, in particular a pistol, a rifle, or a carbine, in particular in correspondence with the introductory part of Claim 1.

2. Description of Related Art

Upon passing through the barrel of a firearm, deformations are applied to the projectile by means of the contact with the inner surface of the barrel, which may serve to ascribe to a projectile the weapon from which it was shot. This possibility has been used over many years in forensics, but as a result of the arrangements of the inner surface of the barrels which are better and better, more and more precise, and thus which have been provided with fewer variations from weapon to weapon, it has resulted that differences of that sort were more and more difficult to determine. For several years, there have now been barrel cross sections which no longer consist of grooves and lands, as was previously the case, but rather have a polygon cross section and are referred to as "polygonal barrels" for short. Since the relative position of the polygon changes continuously along the axis of the barrel, a rotation of the projectile occurs around its longitudinal axis.

The transitions between the single, straight polygon segments are rounded off, and within that context, an equalization occurs with the cross section of the projectile in such a way that the entire cross section surface of the barrel corresponds to the cross section surface of the projectile. Within that context, the caliber measurement is determined with an even-numbered polygon (the polygons that are most used are hexagons) between two linear segments that are opposite each other, and the arched segments consequently lie "outside" of the area that is determined by the caliber. Consequently, the "caliber" circle is in general the inner circle of the linear-running polygon segments. These polygonal barrels are produced through the cold working of a barrel blank over a mandrel which has the desired cross section. The barrels that are formed in that way are then so indistinguishable from one another that in general it is not possible to ascribe a projectile that has been fired to a given barrel, or to rule out a given barrel. With regard to forensics, this represents a considerable disadvantage.

On several occasions, there have been and there are proposals in order to equip conventional barrels with grooves and lands with markings that permit such an ascribing in complete independence of the barrel. In that regard, reference is made to U.S. Pat. No. 6,796,073, to US 2001/0029690, to U.S. Pat. No. 4,175,346, and to AT 402 702. The contents of these documents are incorporated by reference into this present application for the countries in which that is legally possible.

The methods that are cited in these documents for the applying of markings are completely unsuitable for polygonal barrels. A need consequently exists for a corresponding marking and a method for its application.

It is the problem of the invention to provide such a method or a marking that is received through it. Within that context, the quality of the barrel may not be compromised, and the costs of the manufacturing should not noticeably increase.

SUMMARY OF THE INVENTION

The invention concerns a marking for the barrel of a firearm, in particular of a pistol, a rifle, or a carbine, with a barrel cross section the perimeter of which alternately consists of linear, polygonal segments and arched segments, where necessary with transitions between them, whereby the linear, polygonal segments define an inscribed circle, further comprising at least two ribs being provided in or on the arched segments which extend radially inward.

DETAILED DESCRIPTION

The following description is presented to enable any person skilled in the art to make and use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

These problems are inventively solved by means of the features that are indicated in the characterizing portion of Claim 1. In other words, the mandrel has a helical slot on its surface which is arranged in one of the arched segments between the linear polygonal segments, and the depth of said slot is so small that in an arrangement, neither its lateral surfaces nor its base cut the inscribed circle of the linear polygon section, and it consequently lies completely outside the inscribed circle, and consequently preferably also outside of the caliber circle. That means that a tangential arrangement is possible on this inscribed circle, or also the formation of a cylindrical slot bottom, but such an extreme approach on the caliber circle and the exceeding of it is only recommended in special cases.

As can already be recognized from this brief explanation, the providing of the slot on the mandrel requires practically no additional work in comparison to the production of conventional mandrels, and the production of the barrel itself does not experience any difference at all from the production of conventional polygonal barrels, and the fact that a different mandrel is used changes nothing in the manufacture.

Interestingly enough, through the providing of the slot on the mandrel, which leads to the formation of a corresponding rib-shaped projection in the barrel, the advantages of the polygonal barrel are not impaired, and thus through the preferred inventive measure of remaining outside of the caliber circle, the gas seal and thus the muzzle velocity of the projectile as well as the higher life expectancy in comparison to barrels with the grooves and lands are not reduced. And the easier cleaning of the interior of the barrel is also maintained.

Figure 1:
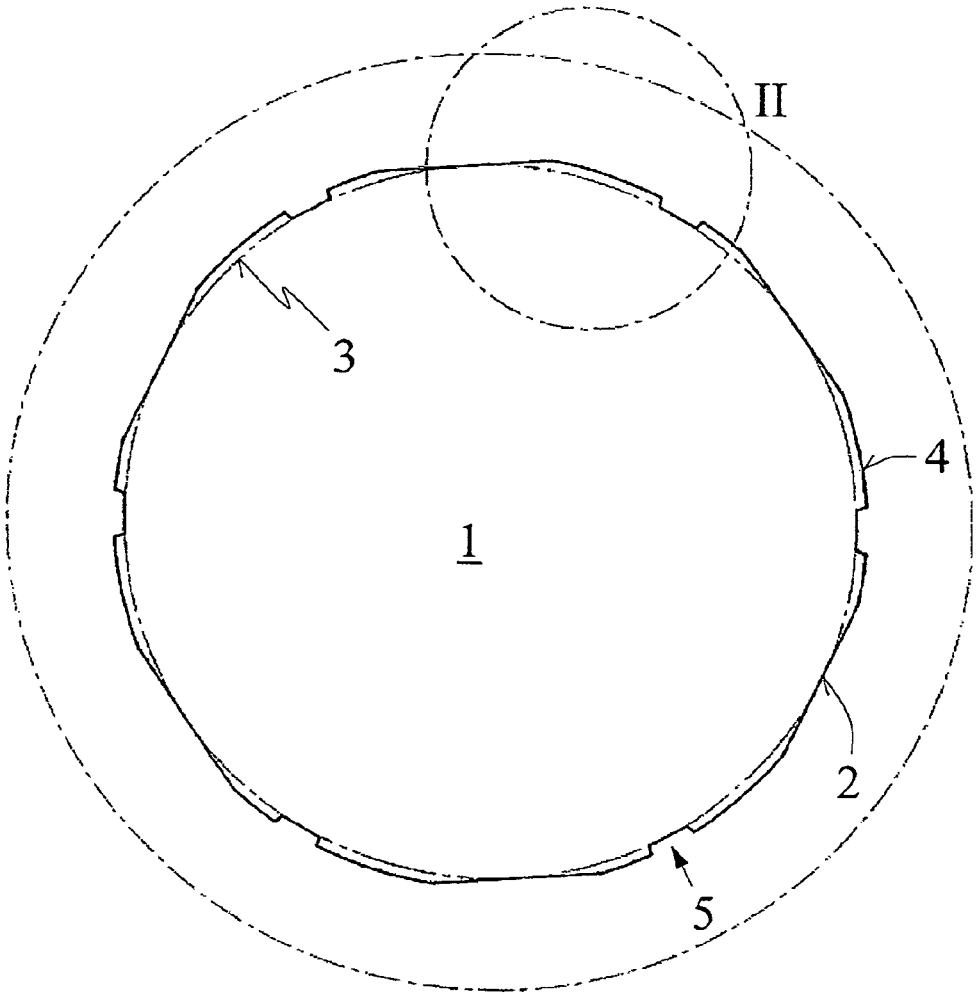
FIG. 1 shows an exemplary polygonal barrel cross section with six linear polygonal segments.
Figure 2:
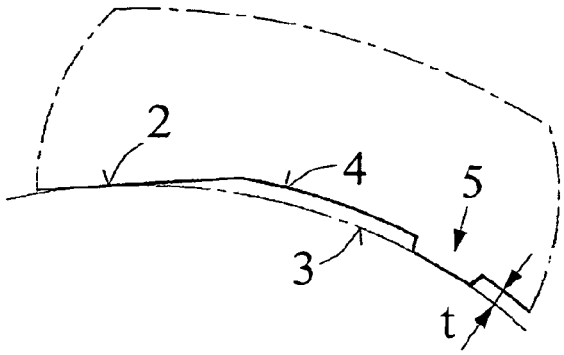
FIG. 2 shows the Detail II of FIG. 1.

The invention shall be explained in greater detail below through the use of the drawing figures. In an exemplary embodiment of FIG. 1, the cross section of polygonal barrel 1 with six linear polygonal segments 2 is depicted, the inscribed circle 3 of which, preferably the caliber circle, corresponds to the caliber measurement. The areas that lie outside of the caliber circle, or the arched segments 4, offset the entire surface of the barrel cross section (without the consideration of the ribs 5) on the entire cross section of the projectile. In each of the six arched segments 4 is centrally located a rib 5 that extends radially inward, their depth t of which is so small that neither the lateral walls of the rib 5 nor its end wall cuts the inscribed circle 3, and with this implementation the rib 5 lies completely outside the caliber circle or on the caliber circle.

Figure 3:
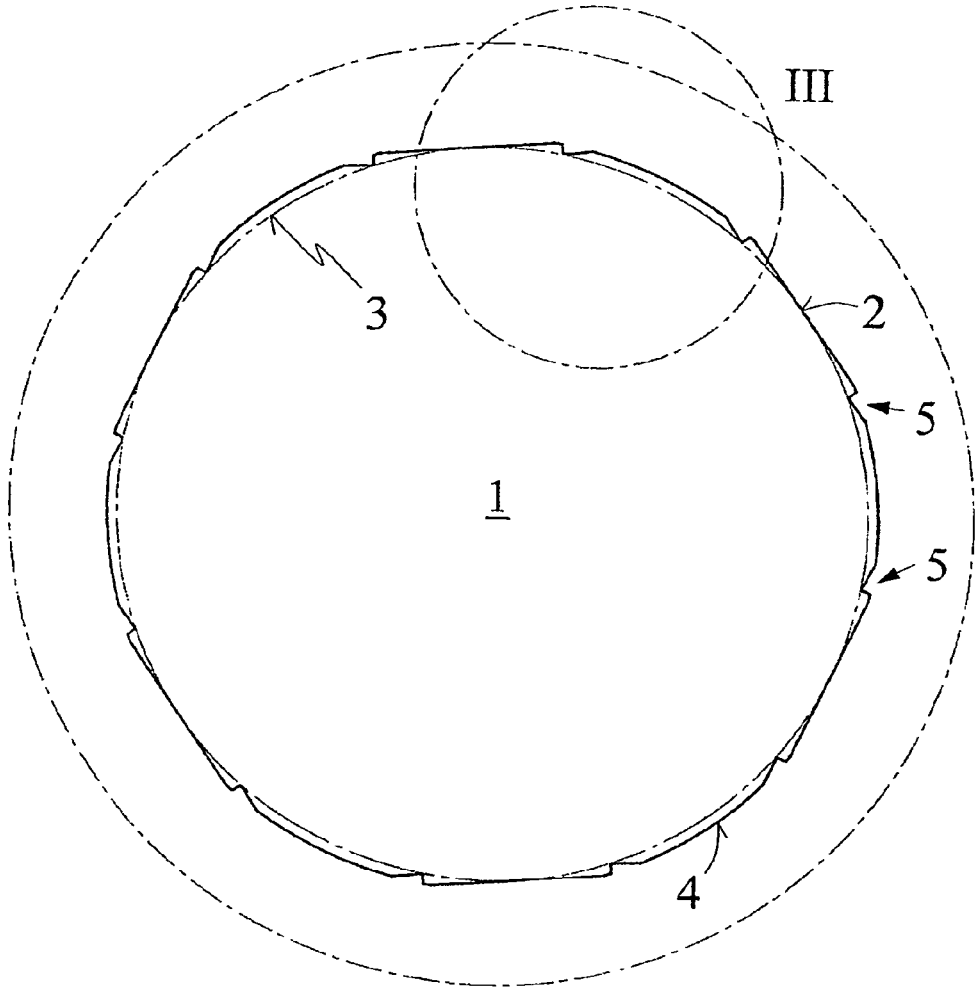
FIG. 3 shows an exemplary polygonal barrel cross section.
Figure 4:
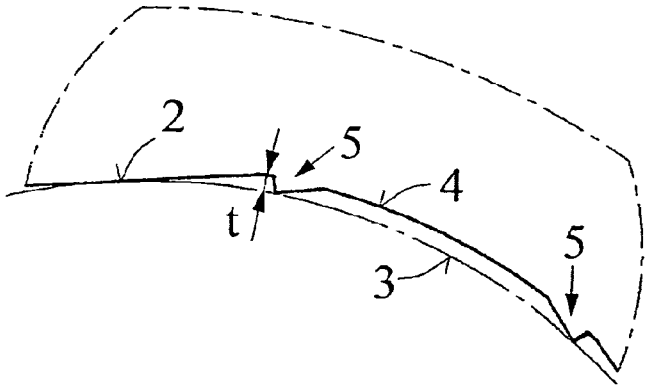
FIG. 4 shows the Detail III of FIG. 3.

FIGS. 3 and 4 depict an alternative exemplary embodiment with a triangular form of the ribs 5 and with an arrangement of the ribs 5 in the transition between the polygonal segments 2 and the arched segments 4, and consequently twelve ribs 5 are provided. Here, as well, their depth t is chosen in such a way as with the first exemplary embodiment, that is, the ribs 5 do not extend into the inscribed circle 3.

The reduction of the cross section surface of the barrel by the ribs 5 is preferably not taken into consideration, but it is possible, however, to do this in whole or in part, in particular if numerous ribs are provided, for example also including more than one in or with one or more of the arched segments 4.

In the first exemplary embodiment that is depicted, a rib 5 is provided that centrally—viewed in the circumference direction—extends radially inward in each of the six arched segments 4, and for reasons of symmetry, this or at least the arrangement of symmetrical ribs may be preferred.

For reasons of clarification, the ribs in both of the exemplary embodiments are depicted extending to the caliber circle; as has been explained above, this is not necessary.

With polygonal barrels with an odd number of linear segments 2, there is likewise always an inscribed circle 3 which preferably corresponds to the caliber circle for these linear segments, such that the invention is also easily applicable there, as well. If two ribs 5 are provided per arched segment 4, then as is the case in the second exemplary embodiment, these may also be arranged directly at the transition to the linear polygonal segments 2 and then preferably have a triangular form, and they may transition in a rounded-off manner into the arched segment 4 and steeply in a tooth-like manner into the linear segment 2, and FIG. 4 shows this through the use of a detail.

It goes without saying that other embodiments are also possible for the ribs 5, in particular those that are rounded off; what is to be taken into consideration is only the manufacture of the slot on the mandrel, the flow motions of the barrel material with cold-forging, and the use of materials of the mandrel and barrel on one hand with the manufacture of the barrel and on the other hand with its use. With the knowledge of the invention, there is no difficulty for the person skilled in the art in the areas of the cold-forging of polygonal barrels to determine the corresponding shapes and measurements, if necessary through the use of a few experiments.

What is claimed is:

1. A polygonal barrel of a firearm, comprising:

a barrel having a cross-sectional profile that corresponds to a rounded regular polygon defined by alternating linear and arched segments, each segment transitioning smoothly into its adjacent segments, the innermost point of each linear segment disposed upon and defining an inscribed circle;

wherein the barrel further includes at least two inwardly extending ribs having profiles that are distinct from and superimposed upon the profile of the rounded regular polygon, each rib extending radially inward from an arched segment of the rounded regular polygon but extending no farther than the inscribed circle.

2. The polygonal barrel of a firearm according to claim 1, wherein the inscribed circle corresponds to the caliber circle.

3. The polygonal barrel of a firearm according to claim 1, wherein the ribs are arranged symmetrically with respect to the barrel axis.

4. The polygonal barrel of a firearm according to claim 1, wherein each rib is disposed in the central portion of its respective arched segment.

5. The polygonal barrel of a firearm according to claim 1, wherein each of the ribs are located in the transition areas between the linear segments and the arched segments.

6. The polygonal barrel of a firearm according to claim 1, wherein each rib has an essentially trapezoidal cross section shape.

7. The polygonal barrel of a firearm according to claim 1, wherein each rib has an essentially triangular cross section shape.

* * * * *